US010046339B2

(12) United States Patent
Zhou et al.

(10) Patent No.: US 10,046,339 B2
(45) Date of Patent: Aug. 14, 2018

(54) SHOWER HEAD OUTLET SWITCHING DEVICE

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Huasong Zhou, Fujian (CN); Fengde Lin, Fujian (CN); Mingfu Zhang, Fujian (CN); Daliang Yang, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/317,032

(22) PCT Filed: Jun. 10, 2015

(86) PCT No.: PCT/CN2015/081152

§ 371 (c)(1),
(2) Date: Dec. 7, 2016

(87) PCT Pub. No.: WO2015/192729

PCT Pub. Date: Dec. 23, 2015

(65) Prior Publication Data

US 2017/0120261 A1 May 4, 2017

(30) Foreign Application Priority Data

Jun. 19, 2014 (CN) ..... 2014 1 0275371

(51) Int. Cl.
*B05B 1/16* (2006.01)
*B05B 12/00* (2018.01)
(Continued)

(52) U.S. Cl.
CPC ..... *B05B 1/1636* (2013.01); *B05B 12/002* (2013.01); *B05B 15/061* (2013.01); *B05B 15/62* (2018.02)

(58) Field of Classification Search
CPC ..... B05B 1/14; B05B 1/16; B05B 1/1627; B05B 1/1636; B05B 12/002; B05B 15/061
See application file for complete search history.

(56) References Cited

U.S. PATENT DOCUMENTS 4,907,744 A * 3/1990 Jousson ..... A61C 17/0202 137/625.44
6,151,729 A 11/2000 Yean

FOREIGN PATENT DOCUMENTS

CN 201702050 U 1/2011
CN 201772107 U 3/2011
(Continued)

*Primary Examiner* — Christopher Kim
(74) *Attorney, Agent, or Firm* — Rabin & Berdo, P.C.

(57) ABSTRACT

A shower head outlet switching device includes a fixing portion having an inlet waterway and at least two diversion waterways; a switching mechanism within the fixing portion and including a water diversion plate that is movable with respect to the fixing portion; a first driving mechanism; and a valve shaft that is slidable with respect to the fixing portion; a driving mechanism including an operation button movably connected to the fixing portion that causes the valve shaft to slide; and a second driving mechanism connected to the valve shaft; and an elastic body directly connected to the driving mechanism and to the fixing portion to reset the driving mechanism. The first driving mechanism is connected to the water diversion plate and the valve shaft so that, when the valve shaft slides one round, the water diversion plate rotates to connect one diversion waterway to the inlet waterway.

11 Claims, 6 Drawing Sheets

(51) Int. Cl.
*B05B 15/06* (2006.01)
*B05B 15/62* (2018.01)

(56) References Cited

FOREIGN PATENT DOCUMENTS

| | | | |
|---|---|---|---|
| CN | 203170460 | U | 9/2013 |
| CN | 103736608 | A | 4/2014 |
| CN | 203598960 | U | 5/2014 |

* cited by examiner

SHOWER HEAD OUTLET SWITCHING DEVICE

FIELD OF THE INVENTION

The present invention relates to an outlet switch device.

BACKGROUND OF THE INVENTION

A function switch device of shower head is published in the Chinese patent database in Jan. 12, 2011, with announcement number CN201702050U. The switch device is disposed to the handle of the shower head, it mainly comprises a valve sleeve, a shaft, a lock catch, a button, a lower cover and an upper cover fastened together; the valve sleeve is disposed with a sleeve hole passing through the valve sleeve from top to bottom in the axial direction, the central portion is disposed with a slut groove, one side of the slut groove is fixedly disposed with an elastic element; the spindle is rotatably disposed in the sleeve hole of the valve sleeve in sealing way, the spindle is disposed with a hole and ratchets annularly arranged corresponding to the slut groove of the valve sleeve; the lock catch combined with the dial button is movably disposed above the valve sleeve, the lock catch is located at the ratchets of the spindle, one end of the lock catch is fixedly connected to the dial button, the other end is engaged to the ratchet of the spindle, the dial button moves and links to the lock catch to drive the spindle to rotates to switch the outlet functions; the components are combined and then disposed into the accommodating chamber formed by the jointing of the lower cover and the upper cover to integrate to the shower head handle, an opening is disposed in the upper cover corresponding to the dial button. It is complicated, it needs large force to operate, and it is not convenient to switch.

SUMMARY OF THE INVENTION

The present invention is provided with an outlet switch device, which overcomes the disadvantages of the existing technology.

The technical proposal of the present invention is that:

An outlet switch device, comprising a fixing portion having an inlet waterway and at least two diversion waterways capable of connecting to the inlet waterway; wherein further comprising:

a switch mechanism assembled in the fixing portion, the switch mechanism comprises a water diversion plate, a first driving mechanism and a valve shaft, the water diversion plate is movable with respect to the fixing portion, the valve shaft is slidable with respect to the fixing portion, the first driving mechanism is connected to the water diversion plate and the valve shaft to make that when the valve shaft sliding one round, the water diversion plate rotates in a certain angle, the water diversion plate rotates to make the diversion waterways switched to connect to the inlet waterway;

a driving mechanism having an operation button and a second driving mechanism, the operation button is movably connected to the fixing portion for user to control and operate, the second driving mechanism is connected to the valve shaft in driving way and operation button moves to drive the valve shaft to slide; and an elastic body connected to the driving mechanism and the fixing portion to make the driving mechanism resettable.

In another preferred embodiment, the second driving mechanism comprises a slide block, a first seesaw and a second seesaw, the slide block is fixedly connected to the operation button, the first seesaw is connected to the fixing portion in swinging way, the slide block moves to drives the first seesaw to swing, the second seesaw is connected to the fixing portion in swinging way, the first seesaw swings to drive the second seesaw to swing, the second seesaw is connected to the valve shaft in driving way, the second seesaw swings to drive the valve shaft to slide.

In another preferred embodiment, the slide block is slidably connected to the fixing portion; the first seesaw is L shaped, the central portion of the L shaped first seesaw is rotatably connected to the fixing portion, the front end of the slide block abuts against the first end of the first seesaw; the central portion of the second seesaw is rotatably connected to the fixing portion, the first end of the second seesaw abuts against the second end of the first seesaw, the second end of the second seesaw is connected to the valve shaft to drive the valve shaft to slide.

In another preferred embodiment, valve shaft is disposed with a pin, the pin has two ends extending out of the valve shaft; the second end of the seesaw is a shifting fork, the shifting fork is connected to the valve shaft in forking way, and two ends of the pin are supported on the shifting fork.

In another preferred embodiment, first end of the second seesaw is concaved with a first through groove, the opening of the first through groove is fixedly disposed with a lateral bar; the fixing portion is disposed with two lugs arranged with space, the two lugs are disposed in the first through groove; the first seesaw is rotatably connected between the two lugs, the second end of the first seesaw abuts against the lateral bar.

In another preferred embodiment, the elastic body is connected to the slide block and the fixing portion.

In another preferred embodiment, the inlet waterway is disposed with a water diversion chamber, each diversion waterway is disposed with a water diversion hole located on the bottom surface of the water diversion chamber;

the bottom surface of the water diversion chamber is concaved with a groove, the groove is disposed with a plurality of first ratchets arranged annularly; the lower end of the valve shaft is disposed with a plurality of second ratchets arranged annularly;

the first diversion plate is disposed with a throughout hole, the periphery of the throughout hole at bottom surface of the water diversion plate is disposed with a plurality of third ratchets annularly arranged; the throughout hole is sleeved on the valve shaft, a spring abuts between the water diversion plate and the top wall of the water diversion chamber, the second ratchet is engaged to the first ratchet, the second ratchet is engaged to the third ratchet, the third ratchets are disposed in the groove.

In another preferred embodiment, the fixing portion is disposed with a water stop passage, the water stop passage is slidably connected to a water stop mechanism; the slide block is slidable between the switch position and the central position and between the central position and the water stop position with respect to the fixing portion, the central position is located between the switch position and the water stop position; the slide block slides from the central position to the water stop position to drive the water stop mechanism to slide to close water, the slide block slides back to the central position from the water stop position to reset the water stop mechanism under the water pressure.

In another preferred embodiment, the fixing portion is disposed with an inlet hole connected to the water stop passage and an outlet hole connected inner side and the outer side of the water stop passage, the inlet hole, the water stop passage and the outlet hole form a part of the inlet waterway;

the water stop passage has a small section and a big section, the inlet hole is disposed at the big section, the outlet hole is disposed at the small section; the water stop mechanism comprises a first water stop base and a second water stop section, the first water stop base is fixedly connected to the second water stop base, the first water stop base is fitting to the big section, the second water stop base is fitting to the small section, the first water stop base closes the inlet hole to close the water; a driving element is provided to fit to the slide block, so that the slide block slides to drive the water stop mechanism to slide by the driving element.

In another preferred embodiment, the slide block is disposed with a deflecting incline surface, the driving element is a rolling ball, the rolling ball abuts against the first water stop base.

In another preferred embodiment, the fixing portion is a shower head having a shower head portion and a handle portion, the shower head portion is disposed with a water diversion chamber, the bottom wall of the water diversion chamber is disposed with water diversion holes connected to the diversion waterways correspondingly, the water diversion chamber forms a part of the inlet waterway.

Compared to the existing known technology, the present invention not only overcomes the disadvantages of the existing known technology, but also has advantages as follows:

The switch mechanism comprises a water diversion plate, a first driving mechanism and a valve shaft, the water diversion plate is movable with respect to the fixing portion, the valve shaft is slidable with respect to the fixing portion, the first driving mechanism connects the water diversion plate and the valve shaft, so that when the valve shaft slides one round, the water diversion plate rotates in a constant angle, the water diversion plate rotates to switch the diversion waterways to connect to the inlet waterway; the driving mechanism comprises an operation button and a second driving mechanism, the operation button is movably connected to the fixing portion for user to operate, the second driving mechanism is connected to the valve shaft in driving way, and the operation button moves to drive the valve shaft to slide, it is compact and labor saving, it is convenient and fast to switch, also, it can be operated by single hand, and it occupies small space.

The slide block moves to drive the first seesaw to swag, the first seesaw swags to drive the second seesaw to swag, the second seesaw swags to drive the valve shaft to slide, the valve shaft slides to drive the water diversion plate to rotate, it is how to realize switch, two seesaws are disposed between the valve shaft and the slide block, two seesaws are used to transmit, it is compact and labor saving, it is convenient and fast to switch, also, it can be operated by single hand, and it occupies small space.

The fixing portion is disposed with a shower head portion and a handle portion, the switch mechanism is disposed in the shower head portion, the slide block is disposed in the handle portion, it also combines with the transmission of two seesaws, the handle portion occupies small space, the structure is compact.

The fixing portion is disposed with a water stop passage, the water stop passage is slidably connected to a water stop mechanism; the slide block can slide between the switch position and the central position and between the central position and the water stop position with respect to the fixing portion; when the slide block slides from the central position to the switch position, it realizes switch, when the slide block slides from the central position to the water stop position, it realizes water stop, when the slide block slides from the water stop position to the central position, the water stop mechanism is reset under the water pressure, the switch method is new and it can be operated by single hand.

The slide block is disposed with a guiding incline surface, the transmission element is a ball, the ball abuts against the first water stop seat, it is labor saving by the rolling connecting.

BRIEF DESCRIPTION OF THE DRAWINGS

The present invention will be further described with the drawings and the embodiments.

FIG. 2-1 illustrates an enlargement diagram of the FIG. 2 in A.

DETAILED DESCRIPTION OF THE EMBODIMENTS

Figure 1:
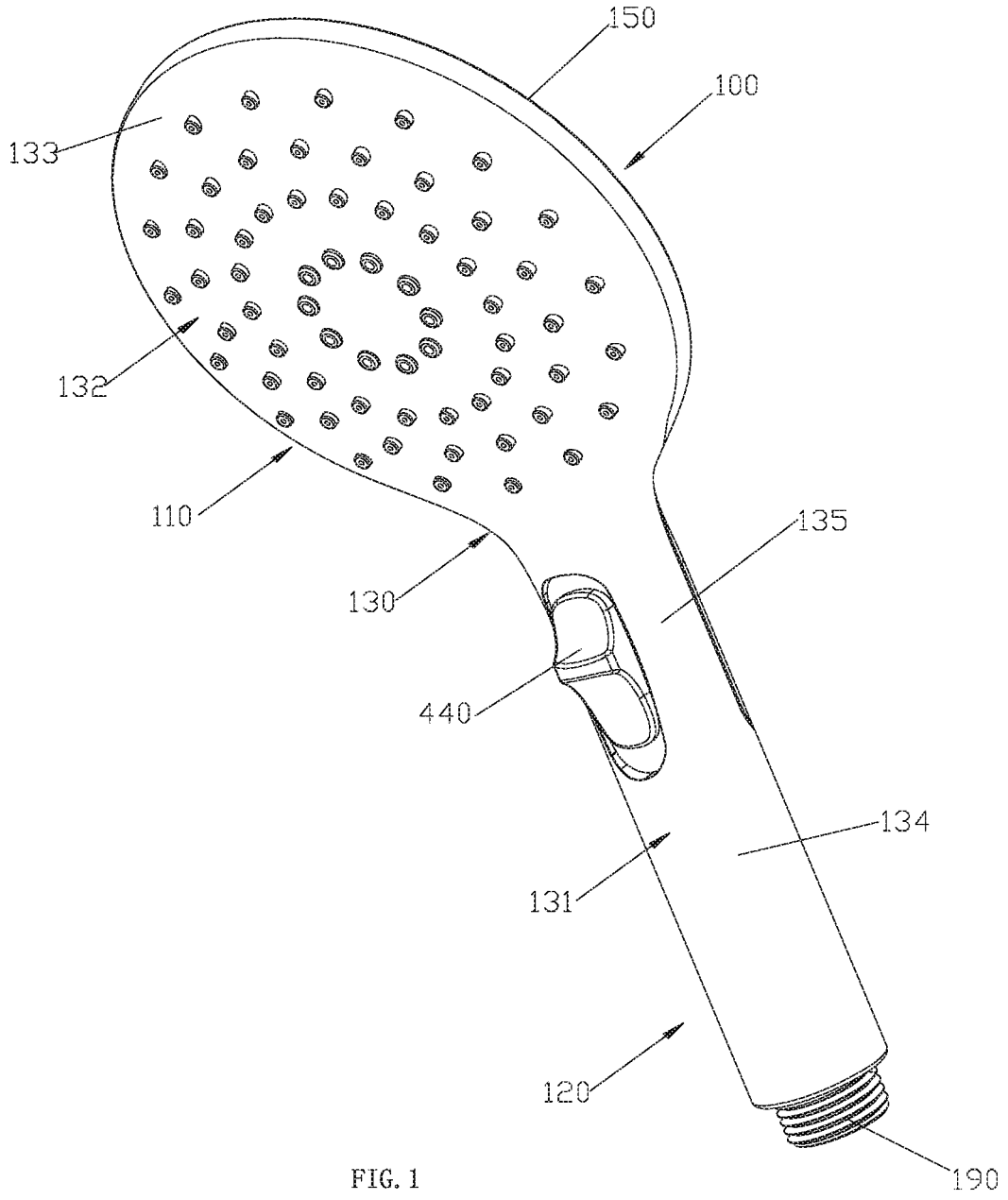
FIG. 1 illustrates a schematic diagram of the outlet switch device.
Figures 1, 2:
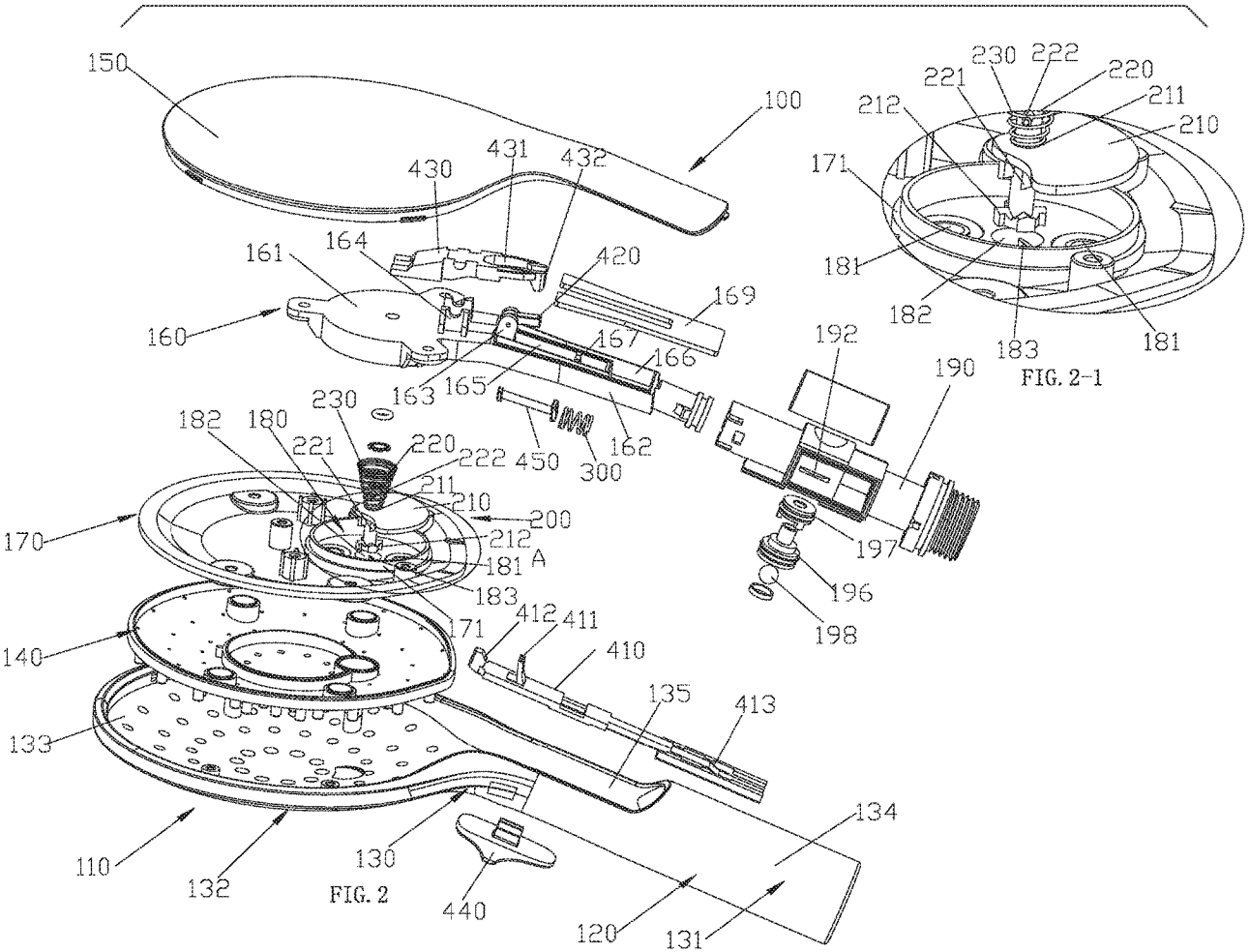
FIG. 2 illustrates an exploded and schematic diagram of the outlet switch device.
Figure 3:
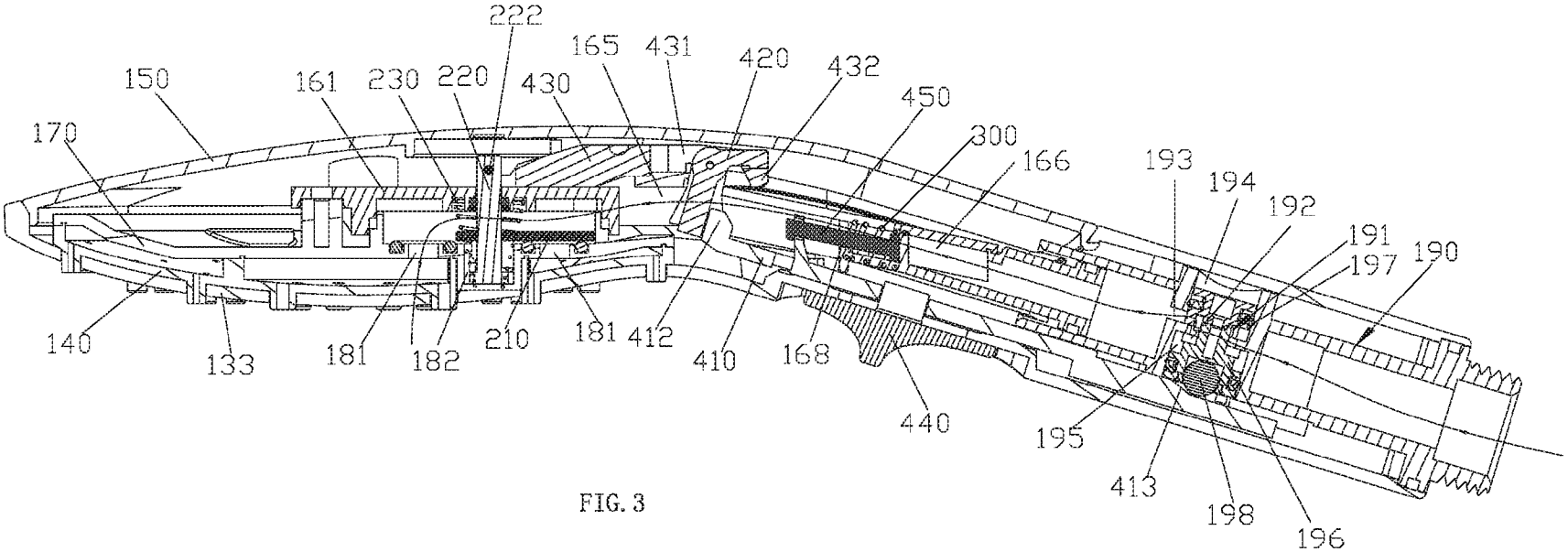
FIG. 3 illustrates a sectional diagram of the outlet switch device when the outlet switch device outlets the first water type.
Figure 4:
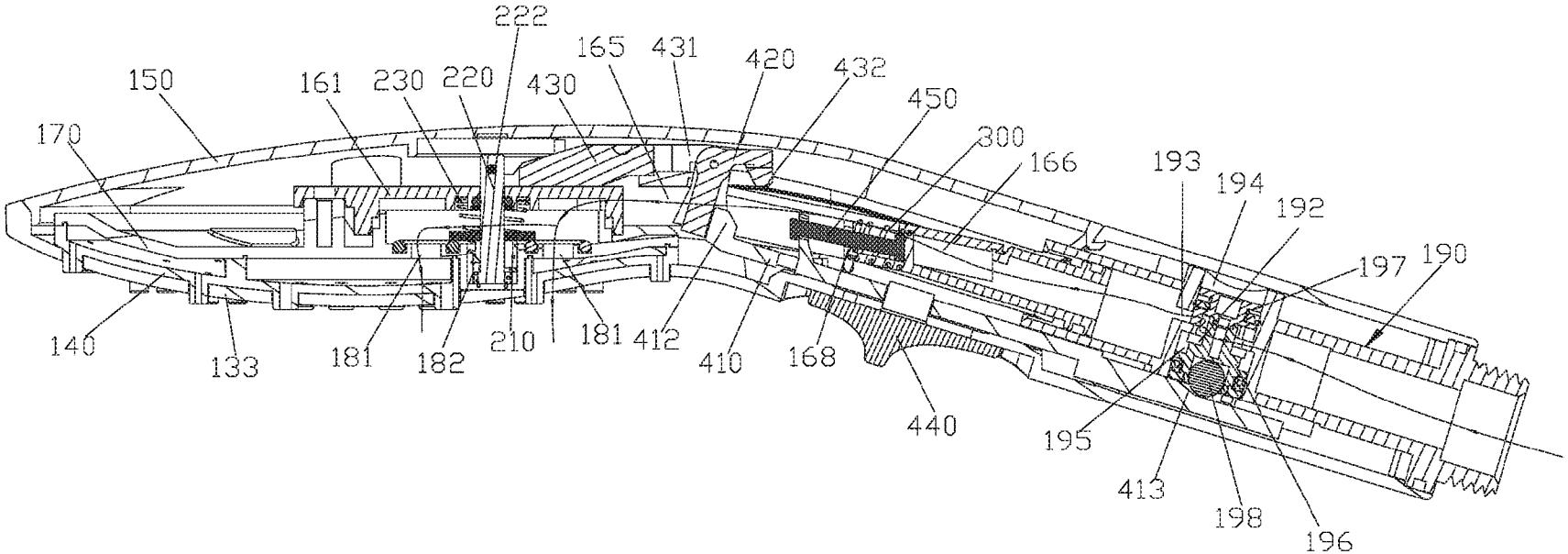
FIG. 4 illustrates a sectional diagram of the outlet switch device when the outlet switch device outlets mixing water type.
Figure 5:
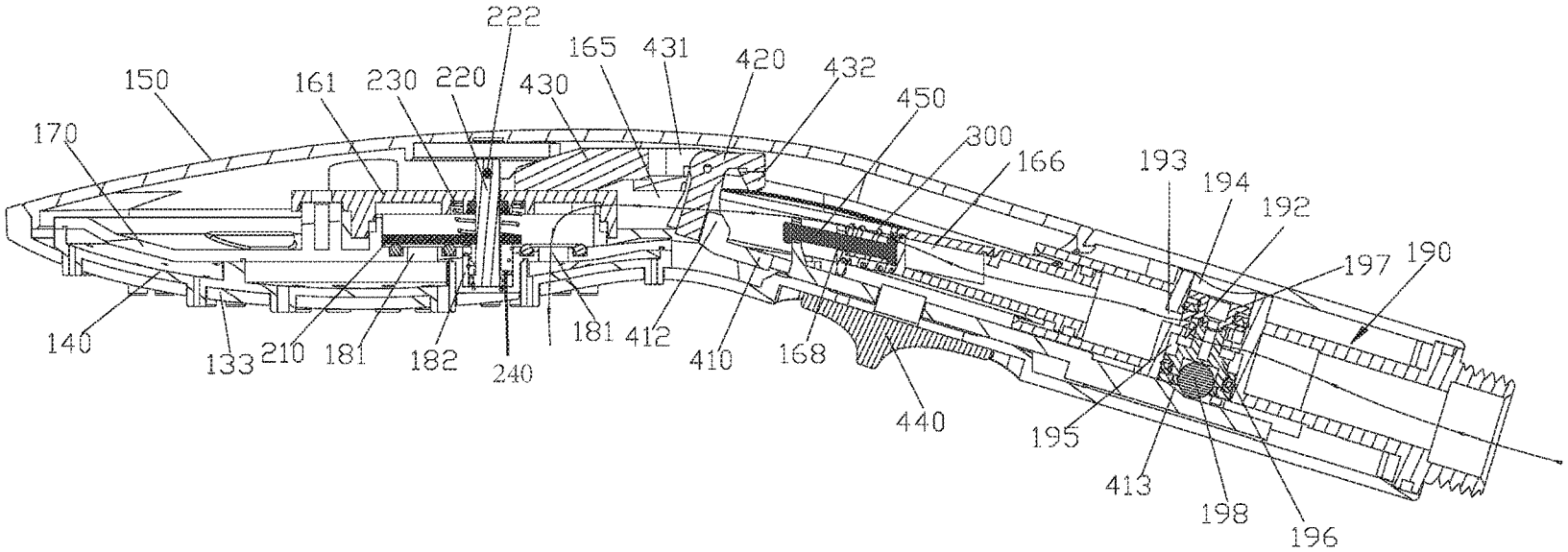
FIG. 5 illustrates a sectional diagram of the outlet switch device when the outlet switch device outlets the second water type.
Figure 6:
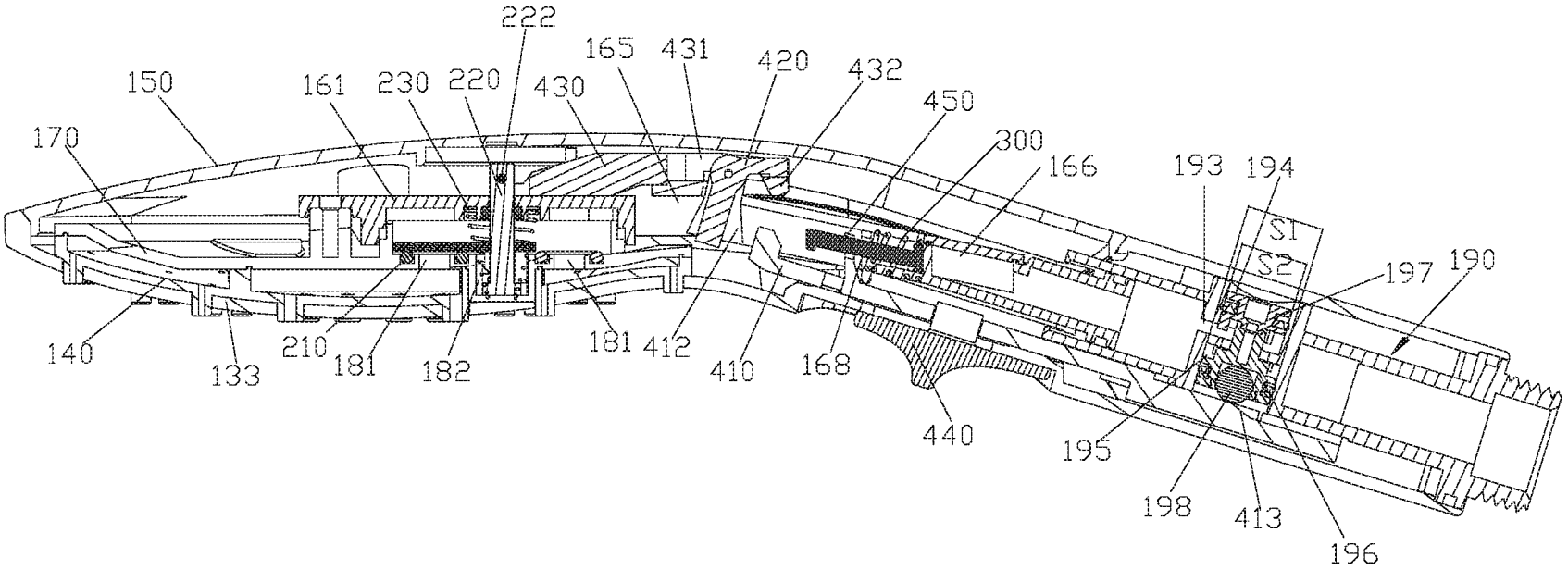
FIG. 6 illustrates a sectional diagram of the outlet switch device when the outlet switch device is turned off.

Referring to FIGS. 1-6, an outlet switch device comprises a fixing portion 100, a switch mechanism 200, a driving mechanism and an elastic body 300.

The fixing portion 100 is disposed with an inlet waterway and at least two diversion waterways connected to the inlet waterway. In this embodiment, the fixing portion 100 is disposed with a shower head portion 110 and a handle portion 120, the shower head portion 110 is disposed with a water diversion chamber 180, the bottom wall of the water diversion chamber 180 is disposed with water diversion holes 181 connected to the diversion waterways one-to-one correspondence, the water diversion chamber 180 forms a portion of the inlet waterway.

The switch mechanism 200 is assembled in the fixing portion 100, the switch mechanism 200 comprises a water diversion plate 210, a first driving mechanism 240 and a valve shaft 220, the water diversion plate 210 is movable with respect to the fixing portion 100, the valve shaft 220 is slidable with respect to the fixing portion 100, the first driving mechanism is connected to the water diversion plate 210 and the valve shaft 220 to make that when the valve shaft 220 slides up and down one round, the water diversion plate 210 rotates forwardly in a certain angle, the water diversion plate 210 rotates to make the water diversion holes 181 switched to connect to the water diversion chamber 180 of the inlet waterway. In detailed, the bottom surface of the water diversion chamber 180 is disposed with a groove 182, a plurality of first ratchets 183 are arranged annularly in the groove 182; the lower end of the valve shaft 220 is arranged annularly with a plurality of second ratchets 221; the water diversion plate 210 is disposed with a through hole 211, the bottom surface of the water diversion plate 210 is disposed annularly with a plurality of third ratchets 212 corresponding to the periphery of the through hole 211; the through hole 211 is sleeved on the valve shaft 220, a spring 230 is sleeved on the valve shaft 220 to abut between the water diversion plate 210 and the top wall of the water diversion chamber 180, the second ratchets are engaged to the first ratchets, the second ratchets are coupled to the third ratchets, the third ratchets are placed in the groove, above structures form the first driving mechanism to make that when the valve shaft 220 slides up and down one round, the water diversion plate 210 rotates forwardly in a certain angle.

The driving mechanism comprises an operation button 440 and a second driving mechanism, the second driving mechanism comprises a slide block 410, a first seesaw 420 and a second seesaw 430. The slide block 410 is slidably connected to the handle portion 120 of the fixing portion 100, the operation button 410 is fixedly connected to the slide block 410 for user to operate and control, so that the user operates the operation button to drive the slide block to slide. The first seesaw 420 is L-shaped, the central portion (bending portion) of the L-shaped first seesaw 420 is rotatably connected to the fixing portion 100, so that the first seesaw 420 can swag with respect to the fixing portion 100, the front end of the slide block 410 abuts against the first end of the first seesaw 420; the central portion of the second seesaw 430 is rotatably connected to the fixing portion 100, so that the second seesaw 430 can swag with respect to the fixing portion 100, the first end of the second seesaw 430 abuts against the second end of the first seesaw 420, the second end of the second seesaw 430 is connected to the valve shaft 220, when the slide block 410 slides to abut against the first end of the first seesaw 420, the first seesaw 420 swags, when the second end of the first seesaw 420 abuts against the first end of the second seesaw 430, the first seesaw swags to drive the second seesaw to swag, the second seesaw 420 swags to drive the valve shaft 220 to slide.

The elastic body 300 is connected to the driving mechanism and the fixing portion 100 to drive the driving mechanism to reset so as to make the slide block 410 reset, the spring 230 of the switch mechanism is used to make the valve shaft 220 reset, so that when the valve shaft 220 slides one round, the water diversion plate 210 rotates in a certain angle.

The fixing portion 100 has detailed structure, for example, it comprises a main body 130, a cover plate component 140, an upper cover 150, a fixing seat 160 and a water diversion body 170.

The main body 130 comprises a handle seat 131 and a head portion seat 132, the head portion seat 132 is disposed with an outlet cover 133, the outlet cover 133 is disposed with throughout holes; the cover plate component 140 is assembled to the outlet cover 133 and the outlet nozzles of the cover plate component 140 pass through the throughout holes one-to-one correspondence. The water diversion body 170 is fixedly connected to the cover plate component 140 in sealing way to form above mentioned at least two diversion waterways, different diversion waterway corresponds to different water type. The top surface of the water diversion body 170 is protruding with an annular wall 171, the fixing seat 160 is fixedly covering on the annular wall 171 in sealing way, so that the water diversion chamber 180 is formed in the annular wall 171, the portion of the water diversion body 170 corresponding to the annular wall 171 is the bottom wall of the water diversion chamber, the portion of the fixing seat 160 corresponding to the annular wall 171 is the top wall of the water diversion chamber. The fixing seat 160 is disposed with a fixing connecting portion 161 fixedly connected on the annular wall 171 in sealing way and an extending portion 162 fixedly connected to the fixing connecting portion 161. The extending portion 162 is disposed with an inlet portion, one end of the inlet portion is connected to the water diversion chamber, the other end is connected to the water supply portion, the inlet portion and the water supply portion are a portion of the inlet waterway. The upper cover is fixedly connected to the head portion seat 132 of the main body and the cover plate component 140, the fixing seat 160 and the water diversion body 170 are disposed between the upper cover and the head portion seat.

To make the switch mechanism and the driving mechanism with more reliable and compact structure, it is configured preferred that:

The upper end of the valve shaft 220 freely passes through the top wall of the water diversion chamber in sealing way, in this embodiment, the upper end of the valve shaft 220 freely passes through the fixing seat 160 in sealing way; a fixing pin 222 is fixedly connected to the extending portion of the valve shaft 220 with two ends extending out of the valve shaft 220; the second end of the second seesaw 430 is disposed to be a shifting fork, the shifting fork is connected to the valve shaft 220 in forking way, and two ends of the fixing pin are supported on the shifting fork.

The extending portion 162 of the fixing seat 160 is disposed with an assembly through groove 165 passing through the extending portion 162 from top to bottom, the extending portion 162 is protruding with two first lugs 162 with space, the two first lugs 163 are corresponding to two sides of the assembly through groove 165, the first seesaw 420 is placed in the assembly through groove 165 and pivoted between the two first lugs 163, the first seesaw 420 can swag in the assembly through groove 165.

The first end of the second seesaw 430 is concaved with a first through grove 431 passing through from top to bottom, the groove opening of the first through groove 431 is fixedly disposed with a lateral bar 432, the first seesaw 420 is placed in the first through groove 431, the second end of the first seesaw abuts against the lateral bar. Preferred, the top surface of the lateral bar is lower than the top end of the first through groove 431 to form a step, the second end of the first seesaw 420 has the height coupled to the height of the step; or/and the two first lugs 163 extends into the first through groove.

The fixing portion 161 is protruding with two second lugs 164, the second lug 164 is concaved with a semi-circle grove, the bottom surface of the upper cover 150 is protruding with two third lugs, the third lug is concaved with a semi-circle groove, the upper cover is fixedly connected to the fixing seat, the semi-circle grooves couple to a circle groove, the second seesaw is pivoted to the circle groove.

The handle seat 131 is disposed with an end pipe 134 and a U-shaped groove 135 fixedly connected between the end pipe and the head portion seat 132, the upper cover covers the opening of the U-shaped groove. The slide block 410 is slidably connected to the U-shaped groove 135 and is located below the fixing seat 160; the first end of the first seesaw 420 extends out of the assembly through groove 165, the front end of the slide block 410 is protruding upwardly with an abutting block 412, at least a portion of the abutting block 412 is inserted to the assembly through groove 165, the abutting block 412 abuts against the first end of the first seesaw 420. The groove bottom of the U-shaped groove is disposed with a slide hole, the operation button is disposed at the outer side of the U-shaped groove and it passes through the slide hole to fixedly connect to the slide block so as to drive the slide block to slide.

The inlet portion of the fixing seat 160 comprises an inlet section 166 to connect to the water supply portion, two diversion sections 167 respectively at two sides of the assembly through groove and a converging section connecting the two diversion sections 167, the converging section is connected to the water diversion chamber. To be convenient to assemble, as needed, the fixing seat is concaved with a water groove, a cover plate 169 is fixedly connected to the groove opening of the water groove in sealing way to make the water groove form above mentioned two diversion sections 167 and a part of the inlet section 166.

The elastic body 300 is connected to the slide block 410 and the fixing portion 100. In detailed, the front end of the slide block is protruding with a first connecting lug 411, the first connecting lug 411 forms a shifting fork structure; the lower groove opening of the assembly through groove of the fixing seat 160 is fixedly disposed with a suspending plate, the end of the suspending plate is protruding with a second connecting lug 168, the second connecting lug 168 forms a shifting fork structure; a connecting bar 450 is further provided, the front end and the rear end of the connecting bar 450 are protruding with a protruding ring, the connecting bar 450 is connected in the shifting forks of the first connecting lug 411 and the second connecting lug 168, the protruding ring at the front end is placed in the front of the first connecting lug, the protruding ring at the rear end is placed behind the second connecting lug, the elastic body is a spring sleeved on the connecting bar abutting between the second connecting lug and the protruding ring at the rear end.

A spindle 190 is fixedly disposed in the end pipe 134 of the main body of the fixing portion 100, the spindle 190 is disposed with a water passage and a water stop passage 191 passing through the spindle 190 from top to bottom, the water stop passage 191 is slidably connected with a water stop mechanism; the slidable block 410 is slidable between a switch position and a central position and between the central position and a water stop position with respect to the fixing portion 100, the central position is between the switch position and the water stop position; when the slide block slides from the central position to the water stop position, it drives the water stop mechanism to slide to stop water; when the slide block 410 slides from the water stop position to the central position, the water stop mechanism is reset under the water pressure. The detailed structure is that;

The spindle 190 is disposed with an inlet hole 192 connected to the water stop passage 191 and outlet hole 193 connected from the inner side of the water stop passage 191 to the outer side of the water stop passage, the inlet hole, the water stop passage and the outlet hole form a portion of the water stop passage, the outlet hole is connected to the water diversion chamber, or in other words, it is connected to the water diversion chamber by the inlet passage, in detailed, the outlet hole is connected to the inlet section 166 of the inlet passage.

The water stop passage 191 has a small section 194 and a large section 195, the inlet hole is disposed at the large section, the outlet hole is disposed at the small section; the small section 194 and the large section 195 are arranged at the top and the bottom.

The water stop mechanism comprises a first water stop seat 196 and a second water stop seat 197, the first water stop seat is fixedly connected to the second water stop seat, the first water stop seat is coupled to the large section, the second water stop seat is coupled to the small section, the second water stop seat is located above the outlet hole, the water stop seat closes the inlet hole to realize water stop. A water clearance is formed between the connecting position of the first water stop seat 196 and the second water stop seat 197 and the water stop passage, so that water flows from the inlet hole to the outlet hole through the water clearance, and then flows out of the outlet hole.

The bottom surface of the water stop seat is concaved with a connecting groove, a ball 198 is placed in the connecting groove, the ball has at least a portion extending out of the groove opening of the connecting groove, that is to say, the depth of the connecting groove is smaller than the diameter of the ball; the slide block 410 is disposed with a guiding incline surface 413 and a first plane and a second plane respectively connected to the two sides of the guiding incline surface 413, the first plane, the guiding incline surface 413 and the second plane are arranged from front to rear, the ball is connected to the guiding incline surface 413, the first plane and the second plane in rolling way.

To further describe this embodiment, the switch water stop principle would be briefly described:

In the initial state, the water diversion plate closes the first water diversion hole, the second water diversion hole is connected to the water diversion chamber, water flows out of the second diversion waterway;

The slide block slides from the central position to the switch position, the slide block abuts against the first end of the first seesaw to drive the first seesaw to swag, the second end of the first seesaw abuts against the first end of the second seesaw to drive the second seesaw to swag, the second end of the second seesaw drives the valve shaft to slide upwardly, the water diversion plate rotates a half of a constant angle by the first driving mechanism, when the user releases the slide block, the slide block slides from the switch position to the central position under the elastic force of the elastic body, the valve shaft is reset under the action of the spring, the water diversion plate rotates a half of the constant angle again, the switch is finished, the water diversion plate is disposed between the two water diversion holes, two water diversion holes are connected to the water diversion chamber, mixing water flows out; the slide block slides forwardly and resets to make the water diversion plate rotates a constant angle again to close the second water diversion hole, meanwhile, the first water diversion hole is connected to the water diversion chamber, water flows out of the first diversion waterway. This embodiment takes two diversion waterways for example, but not limited to this, more than two diversion waterways are available.

The slide block slides backwardly from the central position to the water stop position, the coupling position of the ball is changed from the second plane to the first plane through the guiding incline surface, during the coupling of the guiding incline surface, the ball moves upwardly to abut against the water stop mechanism to slide upwardly, so that the first water stop seat closes the inlet hole to realize water stop. When the slide block slides from the water stop position to the central position, as the pressure area S1 the first water stop seat is pressed is larger than the pressure area S2 the second water stop seat is pressed, the water stop mechanism slides and resets under the water pressure to realize water flowing.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with an outlet switch device, which has an elastic body to reset the driving mechanism; with two seesaws for transmission, it is compact structural, labor saving and convenient and fast to switch, it is available in varies of outlet mechanism that it has well industrial applicability.

The invention claimed is:

1. A shower head outlet switching device, comprising:

(a) a fixing portion having an inlet waterway and at least two diversion waterways connectable to the inlet waterway;

(b) a switching mechanism that is accommodated within the fixing portion and that is comprised of:

a water diversion plate that is movable with respect to the fixing portion;

a first driving mechanism; and a valve shaft;

(c) a driving mechanism comprising:

an operation button that is movably connected to the fixing portion for a user to control and operate the shower head outlet switching device and that causes the valve shaft to slide; and a second driving mechanism connected to the valve shaft in a driving way; and (d) an elastic body directly connected to the second driving mechanism and connected to the fixing portion to reset the driving mechanism, wherein the first driving mechanism is connected to the water diversion plate and the valve shaft so that, when the valve shaft slides up and down one round, the water diversion plate rotates in a certain angle to switch and connect one diversion waterway of the at least two diversion waterways to the inlet waterway, wherein the second driving mechanism comprises:

a slide block fixedly connected to the operation button and having a front end;

a first seesaw connected to the fixing portion in a swinging way, driven by motion of the slide block, and having a first end, a center portion, and a second end; and a second seesaw that is connected to the fixing portion in a swinging way, that is driven by swinging of the first seesaw and that is connected to the valve shaft in a driving way by swinging to drive the valve shaft to slide, and having a first end, a center portion, and a second end.

2. The shower head outlet switching device according to claim 1, wherein the slide block is slidably connected to the fixing portion; the first seesaw is L shaped and the central portion thereof is rotatably connected to the fixing portion, the front end of the slide block abuts against the first end of the first seesaw; the second seesaw is rotatably connected to the fixing portion, the first end of the second seesaw abuts against the second end of the first seesaw, and the second end of the second seesaw is connected to the valve shaft to drive the valve shaft to slide.

3. The shower head outlet switching device according to claim 2, wherein valve shaft is disposed with a pin, the pin has two ends extending out of the valve shaft; the second end of the second seesaw is a shifting fork, the shifting fork is connected to the valve shaft in a forking way, and two ends of the pin are supported on the shifting fork.

4. The shower head outlet switching device according to claim 2, wherein first end of the second seesaw is concaved with a first through groove, the opening of the first through groove is fixedly disposed with a lateral bar; the fixing portion is disposed with two lugs arranged with a space, the two lugs are disposed in the first through groove, the first seesaw is rotatably connected between the two lugs, and the second end of the first seesaw abuts against the lateral bar.

5. The shower head outlet switching device according to claim 1, wherein the elastic body is connected to the slide block and to the fixing portion.

6. The shower head outlet switching device according to claim 1, wherein the inlet waterway is disposed with a water diversion chamber and each diversion waterway of the at least two diversion waterways is disposed with a water diversion hole defined in a bottom surface of the water diversion chamber, wherein he bottom surface of the water diversion chamber is concaved and has a groove and the groove is disposed with a plurality of first ratchets that are arranged annularly, the valve shaft has a lower end that is disposed with a plurality of second ratchets that are arranged annularly, and the water diversion plate has a throughout hole defined in a bottom surface thereof that has a periphery disposed with a plurality of third ratchets that are annularly arranged and that are disposed in the groove, and wherein the throughout hole is sleeved on the valve shaft, a spring abuts between the water diversion plate and a top wall of the water diversion chamber, and each second ratchet of the plurality of second ratchets engages one first ratchet of the plurality of first ratchets and one third ratchet of the plurality of third ratchets.

7. The shower head outlet switching device according to claim 1, wherein the fixing portion is disposed with a water stop passage that is slidably connected to a water stop mechanism, the slide block is slidable between a switch position and a central position and between the central position and a water stop position with respect to the fixing portion, the central position is located between the switch position and the water stop position; the slide block slides from the central position to the water stop position to drive the water stop mechanism to slide to close off water flow, the slide block slides back to the central position from the water stop position to reset the water stop mechanism due to water pressure.

8. The shower head outlet switching device according to claim 7, wherein the fixing portion has defined therein an inlet hole connected to the water stop passage and an outlet hole connected to an inner side and an outer side of the water stop passage, wherein the inlet hole, the water stop passage and the outlet hole form a part of the inlet waterway, wherein the water stop passage has a small section and a big section, the inlet hole is disposed at the big section, the outlet hole is disposed at the small section, wherein the water stop mechanism comprises a first water stop base and a second water stop section, the first water stop base is fixedly connected to the second water stop base and fits within the big section, the second water stop base fits within the small section, the first water stop base closes the inlet hole to close off water flow, and wherein a driving element is provided to fit to the slide block, so that the slide block slides to drive the water stop mechanism to slide by the driving element.

9. The shower head outlet switching device according to claim 8, wherein the slide block is disposed with a deflecting incline surface, and the driving element is a rolling ball that abuts against the first water stop base.

10. The shower head outlet switching device according to claim 8, wherein the fixing portion is a shower head having a shower head portion and a handle portion, the shower head portion is provided with a water diversion chamber having a bottom wall defined through which is at least two water diversion holes that correspondingly connect to respective ones of the at least two diversion waterways, and wherein the water diversion chamber forms a part of the inlet waterway.

11. The shower head outlet switching device according to claim 1, wherein the inlet waterway is disposed with a water diversion chamber and each diversion waterway of the at least two diversion waterways is disposed with a water diversion hole defined in a bottom surface of the water diversion chamber;

wherein the bottom surface of the water diversion chamber is concaved and has a groove and the groove is disposed with a plurality of first ratchets that are arranged annularly, the valve shaft has a lower end that is disposed with a plurality of second ratchets that are arranged annularly, and the water diversion plate has defined in a bottom surface thereof a throughout hole having a periphery disposed with a plurality of third ratchets that are annularly arranged and that are disposed in the groove, and wherein the throughout hole is sleeved on the valve shaft, a spring abuts between the water diversion plate and a top wall of the water diversion chamber, and each second ratchet of the plurality of second ratchets engages one first ratchet of the plurality of first ratchets and one-third ratchet of the plurality of third ratchets.

* * * * *